United States Patent [19]

Voges

[11] Patent Number: 4,531,874

[45] Date of Patent: Jul. 30, 1985

[54] APPARATUS FOR THE ADHESIVE BINDING OF STACKS OF PAPER

[75] Inventor: Wolfgang Voges, Erlangen, Fed. Rep. of Germany

[73] Assignee: Claus Koenig KG, Erlangen, Fed. Rep. of Germany

[21] Appl. No.: 495,586

[22] Filed: May 18, 1983

[30] Foreign Application Priority Data

Jun. 2, 1982 [DE] Fed. Rep. of Germany ..... 3220694

[51] Int. Cl.[3] ..... B42C 9/00

[52] U.S. Cl. ..... 412/37

[58] Field of Search ..... 412/6, 8, 27, 36, 37, 412/901; 156/477.1, 478, 482, 483, 484, 908

[56] References Cited

U.S. PATENT DOCUMENTS

| | | | |
|---|---|---|---|
| 3,911,517 | 10/1975 | Davis | 412/37 |
| 3,926,712 | 12/1975 | Wetzler et al. | 412/37 |
| 3,928,119 | 12/1975 | Sarring | 412/37 |
| 3,953,277 | 4/1976 | Kuhns | 412/37 |
| 3,980,514 | 9/1976 | Rosette et al. | 412/37 |
| 4,187,571 | 2/1980 | Astero | 412/37 |

*Primary Examiner*—Paul A. Bell

*Assistant Examiner*—Paul M. Heyrana, Sr.

*Attorney, Agent, or Firm*—Banner, Birch, McKie & Beckett

[57] ABSTRACT

Apparatus for adhesively binding stacks of pages with a cut portion of adhesive strip has a form forming a trough arrangement to accommodate the back of the stack of pages to be stuck comprising a form bottom and two form walls disposed thereon. The loose pages are jogged into flush condition on an abutment plate and then held in a clamp. After the portion of adhesive strip has been fed into a position covering the trough arrangement, the back of the stack pages is shifted laterally and inserted into the form arrangement and retracted from the form after the portion of adhesive strip has been stuck to the back. The abutment plate is disposed parallel beside the trough arrangement at a higher level than the form walls and the clamp is mounted on a slide guide means which is movable parallel and normal to the plane of the form bottom. The parallel movement of the clamp extends from the abutment plate location to above the trough arrangement and the normal movement of the back of the stack of pages extends from the higher lever of the abutment plate to the form bottom.

12 Claims, 10 Drawing Figures

APPARATUS FOR THE ADHESIVE BINDING OF STACKS OF PAPER

FIELD OF THE INVENTION

The present invention relates to an apparatus for the adhesive binding of stacks of pages which are formed from loose pages and which are held by a clamping means, by means of a cut portion of adhesive strip, including a jig or form which provides a trough arrangement adjustable to the dimensions of the back of the stack of pages which is to be struck, with the form comprising a form bottom and two form walls disposed thereon, and with the apparatus being operable so that the loose stack of pages is pushed into a flush condition against an abutment plate, with the clamping means in the open condition, and thereafter clamped by the clamping means, and, after the portion of adhesive strip has been fed into a position or covering the trough arrangement, the back of the stack of pages is inserted into the form and then retracted from the form again after the portion of adhesive strip has been stuck to the back.

BACKGROUND OF THE INVENTION AND PRIOR ART

An apparatus of that kind is disclosed in German patent specification No. 1 536 499. That apparatus is used for processing cut portions of adhesive strip, which carry a fusion-type adhesive. The apparatus has a clamping means for clamping the stack of pages, the clamping means being fixed in position in respect of height. Arranged below the clamping means is the form or mould means with which the adhesive strip portion is laid around and glued to the back or spline of the stack of pages. The form which comprises a form bottom and two form walls disposed thereon is initially used as a striker or abutment plate for putting the stack of pages into a flush and smooth condition, for which purpose one form wall is moved into contact with the other, thereby forming a continuous striker or abutment plate which is formed by the respective surfaces of the form walls. After the stack of pages has been pushed into a flush condition and subsequently clamped by means of the clamping device, the form is moved away from the clamped stack of pages so that a space is defined between the back of the stack of pages and the respective surface of the form walls. After the stack of pages has been pushed into a flush condition and subsequently clamped by means of the clamping device, the form is moved away from the clamped stack of pages so that a space is defined between the back of the stack of pages and the respective surface of the form walls. Then, the cut portion of adhesive strip is fed from the side onto the form walls which are still held together, and deposited on the form walls, under the back of the stack of pages. The adhesive strip portion is then fixed on one form wall while the other form wall moves away from the first wall, so that between the two form walls is formed the trough arrangement or configuration for the adhesive strip portion to be subsequently laid around and pressed against the back of the stack of pages. The adhesive strip portion, in that operation, initially covers over the trough configuration. Finally, the form is moved back towards the back or spine of the stack of pages, in the opposite direction to the movement away from the stack of pages, with the back being pressed into the trough configuration formed between the two form walls. When that is done, the edges of the adhesive strip portion are laid around the back of the stack of pages, and they are pressed against the outermost pages of the stack of pages, by the sides of the form walls, which are towards the trough configuration. Heating of the form causes the adhesive on the adhesive strip portion to melt, thereby forming an adhesive joint between the adhesive strip portion and the stack of pages. Finally, by again moving the form downwardly, the glue-bound back of the stack of pages is withdrawn from the form, thereby terminating the operating process on that stack of pages.

In the above-described known apparatus, the back of the stack of pages is either directly above or in the trough configuration. That position of the back of the stack of pages means that accessibility to the trough configuration is seriously impaired, and that is a disadvantage particularly when the trough configuration has to be cleaned, because of adhesive which has overflowed thereinto. In addition, the stack of pages, with the clamping means, prevents a view onto the adhesive strip portion which is laid down on the form walls in the position in which they are pushed together and which, for that purpose, after having been supplied to the arrangement, is still held in its position by a holding means which continues to impede a view onto the adhesive strip portion. As a result of that, incorrect positioning of the adhesive strip portion, before the glueing operation, can only be ascertained with difficulty and may therefore be overlooked. They may have the result in particular that an adhesive strip portion which has been properly cut to the correct length is glued in place after it has shifted in the lengthwise direction, with the result that one end of the back or spine of the stack of pages does not have any glue binding thereon, and the other end has an unnecessary projecting portion of adhesive strip which must be subsequently cut off.

OBJECT OF THE INVENTION

An object of the invention is to provide an apparatus having good accessibility to the trough configuration and allowing continuous observation of the adhesive strip portion which is introduced into its operating position.

SUMMARY OF THE INVENTION

According to the invention the abutment plate is disposed parallel beside the trough arrangement at a higher level than the form walls and the clamping means is mounted on a slide guide means which is movable parallel and normal to the plane of the form bottom, the parallel movement of the clamping means extends from the abutment location to above the trough arrangment and the normal movement in respect of the back of a stack of pages extends from the level of the abutment plate to the form bottom.

By virtue of the striker or abutment plate being arranged parallel beside the trough configuration, the trough configuration remains freely accessible, at least during the operation of pushing the stack of pages into a flush position, so that an adhesive strip portion which has been laid in position can be readily observed. The trough configuration is therefore easy to clean, and in addition it is easily possible to observe whether an adhesive strip portion which has been fed into the arrangement is in the correct position for the subsequent glueing operation. The arrangement of the abutment plate, at a higher level than the form walls, ensures that, upon movement of the clamping means with the clamped stack of pages, the back of the pages can be guided freely from the side over the trough configuration, without the back of the stack of pages sliding on any component, during that operation. That could result in the edges of the individual pages of the stack becoming spread or fanned open, which would make it difficult for the stack of pagess to be subsequently inserted into the trough configuration and would possibly result in defective glue binding of the stack of pages. The slide guide means provides that the clamping means performs a horizontal movement which extends only to a position over the trough configuration, while the slide guide means also ensures that the normal movement of the clamping means carries the back of the stack of pages from the level of the abutment plate to the form bottom.

The above-described apparatus may be used to deal with adhesive strip portions which have on the one hand a self-adhesive material or on the other hand a fusion-type adhesive. Particular features of the apparatus, in connection with dealing with adhesive strip portions which bear a fusion-type adhesive will be described in greater detail hereinafter.

In order to ensure that the adhesive strip portion which is laid over the trough configuration is put into and also held in a secure position, before being stuck to the back of the stack of pages, the arrangement desirably has guide bars which cover over the tops of the form walls, which are remote from the form bottom, and accommodate the respective adhesive strip portion between them. In that case, the adhesive strip portion is held at its sides by the guide bars. The guide bars are of an advantageous configuration if they are provided with respective recesses for suitably accommodating the adhesive strip portion, at the sides of the guide bars which are towards the tops of the form walls. The recesses are desirably in the form of grooves.

In order to facilitate inserting the adhesive strip portion between the guide bars, the guide bars are desirably provided at their side at which the adhesive strip portion is inserted, with an upwardly bent portion which enlarges the respective recesss in a funnel-like configuration. That substantially facilitates threading the adhesive strip portion into the guide bars at the entry end thereof. That is particularly important when the adhesive strip is drawn from a roll which is disposed laterally beside the apparatus.

In order to facilitate inserting the back of the stack of pages into the trough configuration, the form walls are desirably provided with bevels or chamfers which enlarge the trough configuration in a funnel-like shape. In order for the resistance applied to the back of the stack of pages by the form walls, when the back is being inserted into the trough configuration, to be uniformly distributed over the length of the back, the bevels or chamfers are desirably of such a configuration that they taper down in the same direction, lengthwise of the form walls. It is however also possible for the tops of the form walls to be arranged to extend at a slightly inclined angle relative to the form bottom along their longitudinal direction, in the same direction in the case of both form walls, thereby also producing the effect that, when the back or spine of the stack of pages is inserted, the pressure forces applied thereto progress uniformly along the length of the back.

In order to facilitate inserting the stack of pages into the trough configuration and withdrawing the stack therefrom, the form is advantageously of such a configuration that at least one form wall is mounted so as to be laterally displaceable, and that form wall is connected to a displacement mechanism which moves the form wall away from the stack of pages before the latter is inserted and before it is withdrawn and, between those phases of displacement, causes the form wall to press against the stack of pages. That arrangement ensures that the operations of inserting and withdrawing the stack of pages take place without pressure forces being applied to the stack of pages by the form walls, such forces coming into effect only beteen the above-indicated phases in the movement of the form wall, that is to say, after the stack of pages has been inserted into the trough configuration and before it is withdrawn therefrom. For that purpose, the displacement mechanism triggers off the operation of applying pressure to the stack of pages by the form wall, which can be effected actively by the displacement mechanism itself, but which can also be effected by a spring bias effect, against which the displacement mechanism withdraws the form wall.

As already mentioned above, the apparatus may also be used for processing adhesive strip portions which carry a fusion-type adhesive. In that case, the form bottom is advantageously provided with a heating means. Now, so that the form walls are not heated excessively by the heating means, the form walls are desirably of such a design that they bear against the form bottom, by way of projections which are distributed along the length of the form walls. That configuration provides for only a limited transfer of heat from the heated form bottom to the form walls. That ensures that the adhesive is heated substantially more in the region of the form bottom than in the region of the form walls, thereby permitting the fusion adhesive to penetrate between the individual pages of the stack of pages in the region of the back thereof, while the adhesive which is heated less strongly in the region of the outer pages of the stack is only heated to such an extent that the adhesive strip portion is glued to said outer pages.

Now, when using adhesive strip portions bearing a fusion-type adhesive, so that the adhesive is not undesirably heated before the stack of pages is inserted into the trough configuration, the guide bars are advantageously held at a spacing from the tops of the form walls. In that case, there is virtually no heat transferred from the form walls to the guide bars, so that an adhesive strip portion which is held between the guide bars is virtually unheated.

Other objects and features of the invention will become apparent from the following detailed description of preferred but non-limitative embodiments and the accompanying drawings made a part hereof and to which reference is made.

BRIEF DESCRIPTION OF THE DRAWINGS

FIG. 1 shows the apparatus, concentrating on the essential components thereof, more specifically in the initial operating phase in which the stack of pages 1 is pushed into a flush condition on the abutment or striker plate 2. In this operating phase, the stack 1 is first held loosely between the two clamping jaws 3 and 4 of the clamping means which is not shown in detail in this Figure (for the clamping means, see FIGS. 9 and 10). The abutment plate 2 rests on a carrier 5 which is supported on the block 7 by way of an interposed plate or bar member 6 which is described hereinafter. The block 7 is fixed on the form bottom 8. The two form walls 9 and 10 are arranged displaceably on the form bottom 8, laterally beside the block 7 and thus in front of the stack 1. The form wall 9 is suspended on the push rod 11 which passes through the block 7 and which is selectively reciprocated by the displacement mechanism 12. The displacement mechanism 12 may be for example a solenoid. In the illustrated position of the push rod 11, the push rod 11 is in a limit position defined by the abutment 13 fixed on the push rod 11. In the illustrated position, the abutment 13 bears against the block 7. Disposed between the block 7 and the form wall 9 on the push rod 11 is a compression spring 14 which, by virtue of its spring force, urges the form wall 9 into the illustrated position. The form wall 10 is selectively reciprocated by means of the adjusting screw 15, thereby adapting the arrangement to the thickness of the respective stack 1 to be bound. The screw 15 is held in known manner with its end in the form wall 10, and passes through the block 16 which is provided with a female thread so that, when the screw 15 is turned, the screw 15 is displaced with respect to the block 16 and thus correspondingly entrains the form wall 10. The block 16 is secured to the form bottom 8, similarly to the block 7.

Figure 1:
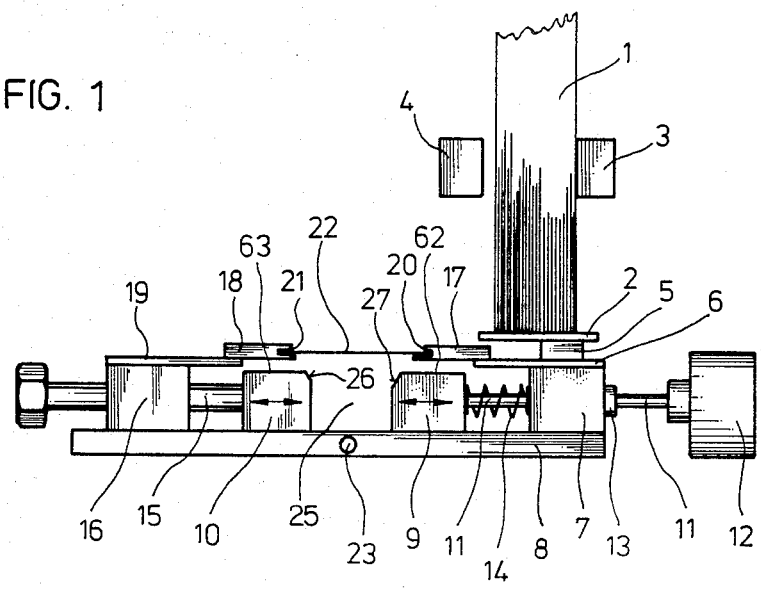
FIG. 1 is a view of the apparatus, restricted to the essential components thereof, in the operating phase of pushing the stack of pages into a flush condition.

The two guide bars 17 and 18 are mounted above the two form walls 9 and 10, more specifically, on the one hand by way of the plate or bar member 6 and on the other hand by way of the plate or bar member 19, the members 6 and 19 covering over the tops 62 and 63 of the form walls 9 and 10.

The two plate or bar members 6 and 19 which are carried by the blocks 7 and 16 project towards the form walls 9 and 10 and at their ends carry the two guide bars 17 and 18, more particularly, in such a position that the guide bars 17 and 18 are maintained at a spacing from the form walls 9 and 10. The two guide bars 17 and 18 are provided, in an inward direction, with respective recesses formed as grooves 20 and 21 respectively. The adhesive strip portion 22 is inserted into the two grooves 20 and 21 and is thus held in the position in which it is fitted, by the two guide bars 17 and 18. Arranged in the form bottom 8 centrally between the two form walls 9 and 10 is the heating cartridge 23 which supplies the necessary heat to the form bottom 8, when dealing with adhesive strip portions which bear a fusion-type adhesive. By virtue of the contact, the heat produced by the heating cartridge 23 is transferred to the two walls 9 and 10. However, the heat generated cannot be transferred to the two guide bars 17 and 18 because, as can be seen, they are held at a spacing from the two walls 9 and 10. There can be virtually no transfer of heat to the guide bars 17 and 18 by way of the two blocks 7 and 16 and the two plate or bar members 6 and 19. The two blocks 7 and 16 may possibly comprise heat-insulating material.

The apparatus shown in FIG. 1 is designed for dealing with adhesive strip portions which have a fusion-type adhesive, by virtue of the provision of the heating cartridge 23. When using self-adhesive strip portions, the heating cartridge 23 is omitted. There is also no need to maintain a spacing between the wall 9 and 10 and the guide bars 17 and 18.

After the stack 1 has been pushed into a flush condition on the plate 2 (see FIG. 1), the two clamping jaws 3 and 4 are moved together by way of the clamping means described hereinafter, and thereby firmly clamp the stack 1.

Figure 2:
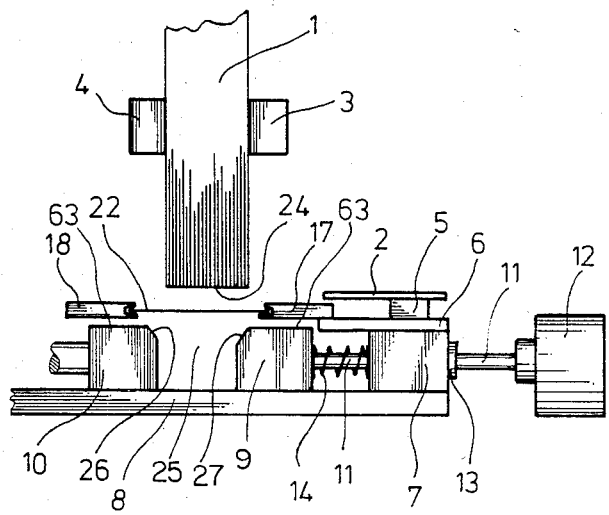
FIG. 2 shows the apparatus in the phase before the stack of pages is introduced into the form.

The clamping means with the two clamping jaws 3 and 4 is then moved into the position shown in FIG. 2 by horizontal movement, with the two clamping jaws 3 and 4 performing a movement parallel to the plane of the form bottom 8. The clamping jaws 3 and 4 with the stack 1 finally take up the position shown in FIG. 2. When that is done, the back 24 of the stack 1 slides away from the plate 2, without internal displacement of the pages of the stack 1 relative to each other. There is no obstacle to the movement of the stack 1 of pages as it moves on into the position shown in FIG. 2, as the plate 2 is disposed beside the trough configuration or arrangement formed by the form bottom 8 and the form walls 9 and 10, at a higher level than the walls 9 and 10.

Figure 3:
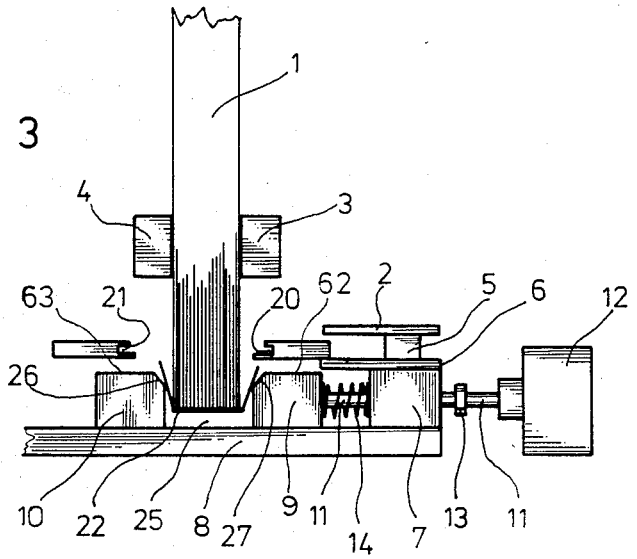
FIG. 3 shows the operating phase of introducing the stack of pages into the form.

FIG. 3 shows the subsequent operating phase in which the clamping means with the clamping jaws 3 and 4 is lowered towards the trough arrangement 25. In that movement, the clamping jaws 3 and 4 entrain the stack 1 which, by means of its back (see reference numeral 24 in FIG. 2) entrains the cut portion 22 of adhesive strip and presses it into the trough configuration 25. When that happens, the lateral edges of the adhesive strip portion 22 slide out of the grooves 20 and 21 in the guide bars 17 and 18. In that operation, the clamping jaws 3 and 4 perform a movement normal to the plane of the form bottom 8.

In order to facilitate the operation of introducing the stack 1 into the trough configuration 25, before the clamping jaws 3 and 4 were lowered, the form wall 9 was retracted by means of the displacement mechanism 12 relative to the position shown in FIGS. 1 and 2, in which the abutment 13 is at a given spacing from the back 7. In that way, the trough configuration 25 is widened, and the steps of introducing and bending round the adhesive strip portion 22 are additionally facilitated by the form walls 9 and 10 being provided with bevels or chamfers 26 and 27 which enlarge the trough configuration 25 in a funnel-like shape.

Figure 4:
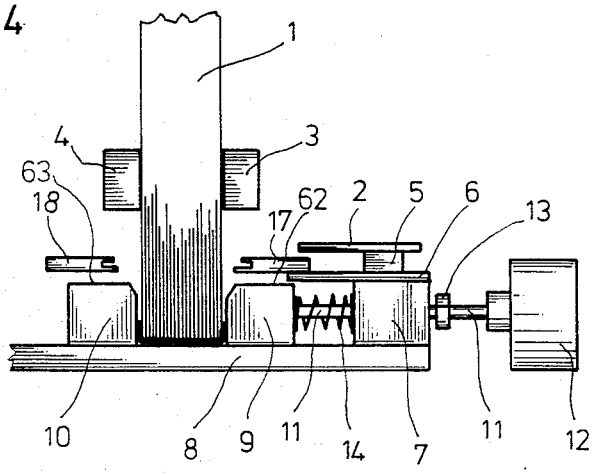
FIG. 4 shows the operating phase wherein the stack of pages is completely introduced into the form.

The downward movement of the clamping means with the two clamping jaws 3 and 4 is over such a height that the back 24 of the stack finally reaches the form bottom 8, with the adhesive strip portion 22 between the back 24 and the form bottom 8 (the reference numerals for denoting the adhesive strip portion 22 and the back 24 are omitted from FIG. 4, for the sake of enhanced clarity of the drawing). FIG. 4 shows the position finally reached by the stack 1. The downward movement of the clamping means with the two clamping jaws 3 and 4 is to such an extent that the back of the stack 1 is pressed against the form bottom 8, thereby intimately glueing together the back 24 and the adhesive strip portion. In addition, after the stack 1 reaches the position shown in FIG. 4, the mechanism 12 is triggered, whereupon the compression spring 14 displaces the push rod 11 towards the left and away from the block 7 until the abutment 13 comes to lie just in front of the block 7. In that position, the force of the compression spring 14 is fully effectively applied to the form wall 9 so that the force of the compression spring 14 can now act on the bent-over edge portions of the adhesive strip portion 22 which can thus be firmly glued to the outer pages of the stack 1.

The necessary step of glueing the back of the stack of pages 1 occurs, as shown in FIG. 4, irrespective of whether the adhesive strip portion is one which has a fusion-type adhesive or a self-adhesive material, except that, when using a fusion-type adhesive, the form bottom 8 must be suitably heated, to which reference has already been made above, in the description with reference to FIG. 1.

After the glueing operation has been completed, the mechanism 12 is actuated to withdraw the form wall 9 into the position shown in FIG. 3, whereby the stack 1 of pages is released so that the stack 1 can be withdrawn from the trough configuration 25 between the form walls 9 and 10, by a movement normal to the plane of the form bottom 8. For that purpose, the clamping means with the two clamping jaws 3 and 4 is moved in the above-indicated direction. The working operation of adhesive binding of the stack of pages 1 is thus completed. For the purposes of glueing the next stack of pages, the clamping means with the two clamping jaws 3 and 4 is then moved back into the position shown in FIG. 1.

Consideration of FIG. 1 readily showed that the trough configuration is readily accessible in the starting position shown in FIG. 1, particularly when no adhesive strip portion 22 has yet been initially introduced into the guide bars 17 and 18. In that starting position, any excess glue which may have escaped may be easily cleaned off the trough configuration 25. In addition, in that position, it is possible readily to observe and if necessary correct the position of the adhesive strip portion 22. There is virtually no possibility of the adhesive strip portion being subsequently displaced as the adhesive strip portion 22 is not touched or moved at all in the subsequent movement of the stack 1 of pages to a position above the trough configuration 25. It is only when the stack 1 of pages is introduced into the trough configuration 25 (see FIG. 3) that the adhesive strip portion 22 is pressed out of its position of being held in the guide bars 17 and 18, in which case however, because the downward movement of the stack 1 of pages can be readily performed rapidly, there is virtually no possibility of relative displacement between the back or spine 24 of the stack 1 and the adhesive strip portion 22.

The adhesive strip in question can be drawn off a roll in the usual manner and introduced into the space between the two guide bars 17 and 18. However, the mechanism to be provided for that purpose has nothing to do with the invention with which we are concerned here, as the apparatus in accordance with the invention described herein is independent of the manner of feeding the adhesive strip. It is only necessary for the adhesive strip, in the form of an adhesive strip portion 22 of the appropriate length, to be moved into the correct position below the back 24 of the stack 1.

Figure 5:
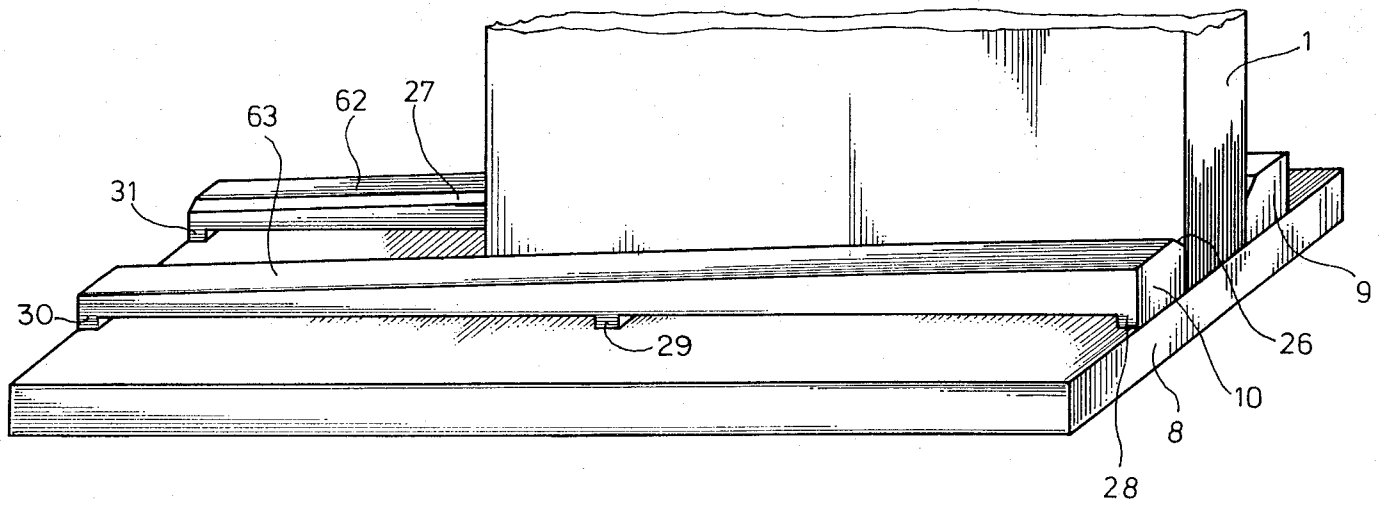
FIG. 5 shows the form with forms walls which are provided with bevels or chamfers, also extending at a slightly inclined angle in the same direction of both form walls, in the longitudinal direction thereof.

FIG. 5 shows the form bottom 8 together with the two form walls 9 and 10 and the stack 1 of pages, without the other components of the apparatus. As will be seen, the form wall 10 is provided with projections 28, 29 and 30 and the form wall 9 is provided with corresponding projections (only the projection 31 is visible in this case). The projections are uniformly distributed along the length of the form walls 9 and 10 and form the means for supporting the form walls 9 and 10 relative to the heated form bottom 8 so that there is only a limited transfer of heat from the form bottom 8 to the form walls 9 and 10. As already mentioned above, that provides that the walls 9 and 10 are held at a lower temperature than the bottom 8.

FIG. 5 also shows that the two form walls 9 and 10 extend at a slightly inclined angle relative to the bottom 8, along the longitudinal direction thereof, more particularly, in the same direction, in both form walls 9 and 10. As a result of that, when the stack 1 of pages is inserted between the two form walls 9 and 10, a pressure is applied to the back of the stack 1 progressively over the length thereof, which would not be the case if the two form walls 9 and 10 were to extend parallel to the bottom 8. In that case, upon insertion of the stack 1, it would suddenly be subjected to a counter-pressure over its entire length, which could detrimentally affect the introduction of the stack 1.

Figure 6:
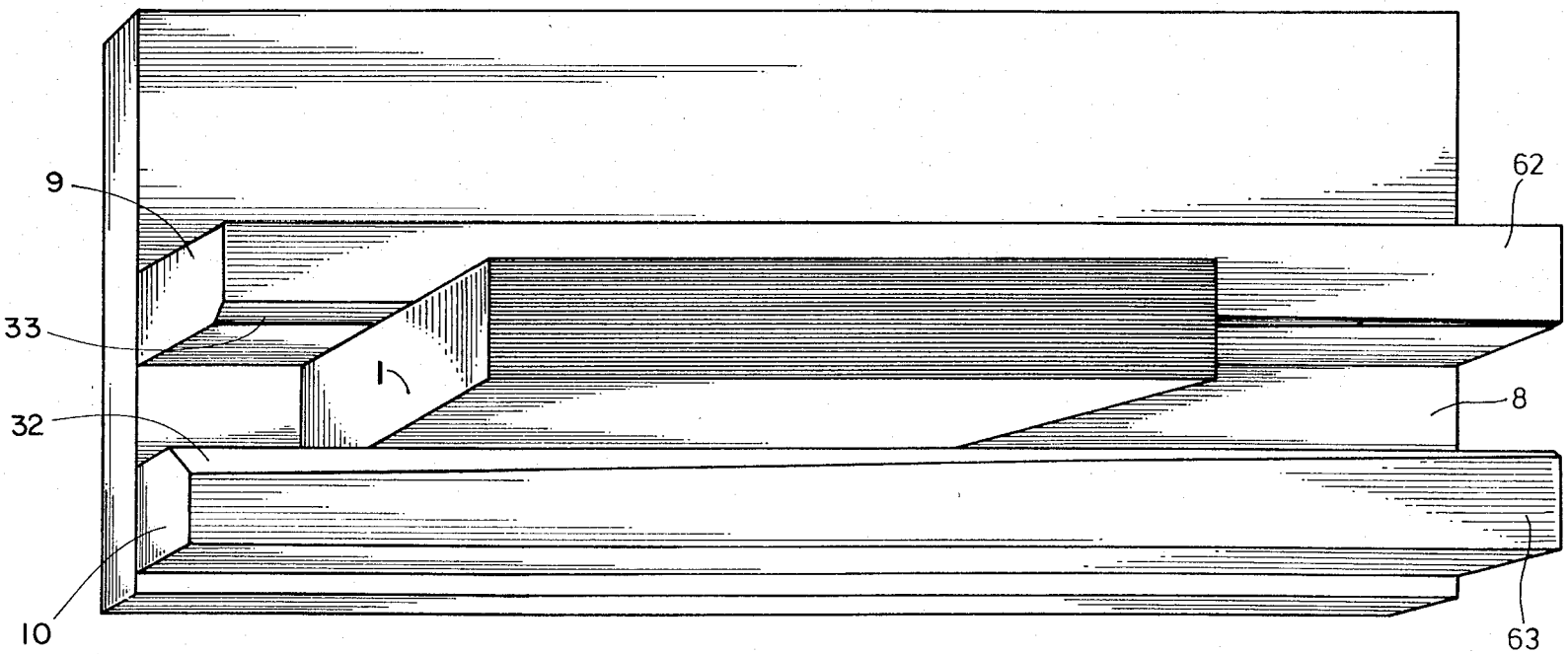
FIG. 6 shows a plan view of the form walls with bevels or chamfers which taper down in the same direction in the lengthwise direction of the form walls.

The effect of uniformly distributing the counter-pressure exerted by the walls 9 and 10, with that counter-pressure being applied progressively lengthwise of the stack 1, is also produced when the funnel-shaped bevels or chamfers on the walls 9 and 10 taper down in the same direction, lengthwise of the walls 9 and 10, as is illustrated at bevels or chamfers 32 and 33 in FIG. 6. Such a tapered configuration of the bevels or chamfers 32 and 33 also provides for progressive application of the counter-pressure exerted on the stack 1 by the walls 9 and 10, when the stack 1 is being introduced between the walls 9 and 10.

Figure 7:
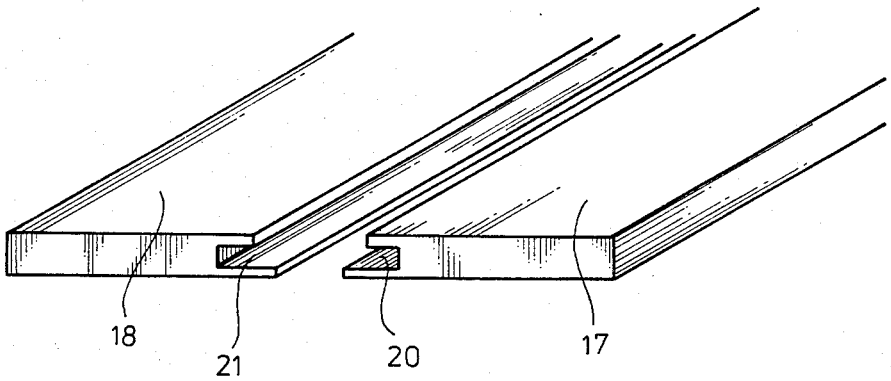
FIG. 7 shows a pair of guide bars with recesses in the form of grooves.

FIG. 7 is a perspective view of two guide bars with the grooves 20 and 21.

Figure 8:
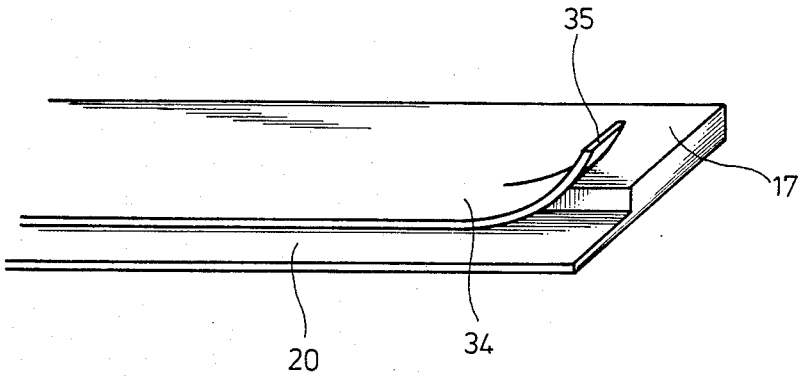
FIG. 8 shows such a guide bar with an upwardly bent portion which enlarged the recess in a funnel-like configuration.

FIG. 8 shows one guide bar 17 in which the upper wall portion 34 of the groove 20 has an upwardly bent portion 35 which is enlarged in a funnel-like configuration, at the entry end for insertion of the adhesive strip portion. The bent portion 35 substantially facilitates inserting the adhesive strip portion into the groove, from the end at which the bent portion 35 is disposed. The oppositely positioned guide bar (not shown) then obviously also has a corresponding bent portion.

Figure 9:
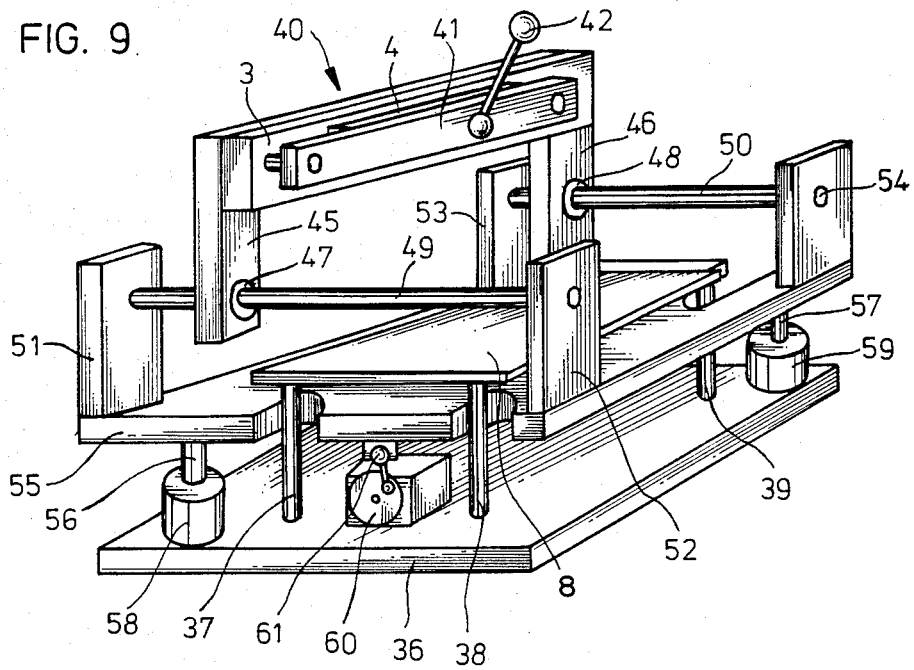
FIG. 9 shows a perspective view of the entire apparatus, with the slide guide means for the two directions of movement of the clamping means, although the components arranged on the form bottom are omitted for the sake of simplicity of the drawing.
Figure 10:
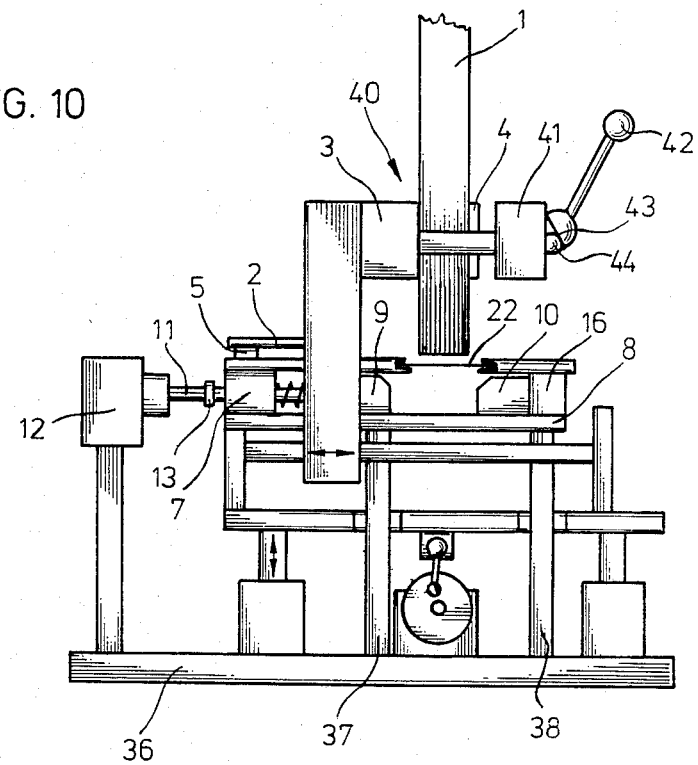
FIG. 10 shows a side view of the FIG. 9 apparatus, with the guide bars and the form walls which are arranged on the form bottom.

FIGS. 9 and 10 show the complete apparatus, except that in FIG. 9 the components which are positioned on the bottom 8 are omitted for the sake of enhanced clarity of the drawing (although they are illustrated in FIG. 10). FIGS. 9 and 10 show that the apparatus is mounted on a base plate 36 from which project the support members 37, 38, 39 for carrying the form bottom 8 at a defined height (a fourth such support member is not visible). FIG. 10 shows that, as illustrated in FIGS. 1 through 4, the walls 9 and 10 are arranged on the bottom 8. With regard to further details in connection with the bottom 8, walls 9 and 10 and the components which are associated therewith, attention is directed to the description relating to FIGS. 1 through 4.

Also illustrated is the clamping means 40 with the two clamping jaws 3 and 4. Arranged in front of the clamping jaw 4 is the support bar 41 on which the rotary lever 42 is mounted. The rotary lever 42 terminates in an inclined surface 43 which, when the rotary lever 42 is rotated, presses with a greater or lesser force on the axially movable pin 44 which extends through the bar 41 and which presses against the clamping jaw 4, by means of its end which is remote from the surface 43. Thus, rotation of the lever 42 causes the clamping jaw 4 to be pressed against the clamping jaw 3, thus clamping a stack 1 of pages which is inserted between the clamping jaws 3 and 4.

The clamping means 40 is supported on the two cylindrical shafts 49 and 50 by way of the two strut members 45 and 46, and by way of the two mounting bushes 47 and 48. The two shafts 49 and 50 are fixed at their ends in respective ones of the support bar members 51, 52 and 53, 54 respectively. By virtue of that mounting arrangement, the clamping means 40 may be slid in the direction of the shafts 49 and 50.

The support members 51, 52 and 53, 54 are fixedly mounted on the carrier plate 55 which in turn rests on the cylindrical shafts 56 and 57.

The shafts 56 and 57 project into the two mounting bushes 58 and 59 so that the shafts 56 and 57 are axially displaceable relative to the bushes 58 and 59.

The result of that mode of mounting the clamping means 40 is that the clamping means may be displaced on the one hand horizontally and on the other hand vertically, thereby providing the necesssary mobility for a stack 1 of pages to move from the position shown in FIG. 1 into the other operating positions.

In accordance with the embodiment illustrated, the clamping means 40 is movable horizontally along the shafts 49 and 50 by hand. Vertical movement of the carrier plate 55 and therewith the clamping means 40 is effected by means of the eccentric drive 60 which engages in known manner into a mounting means 61 on the carrier plate 55. When the eccentric 60 is rotated, the carrier plate 55 performs a corresponding upward and downward movement.

I claim:

1. Apparatus for adhesively binding stacks of loose pages with an adhesive strip comprising:

a form providing a trough arrangement adjustable to the back of the stack of pages to be bound, said form including a form bottom and two form walls disposed thereon;

an abutment plate disposed parallel to the form bottom and to the walls of said trough arrangement at a higher level than said form walls, said plate serving to support a loose stack of pages to be jogged into flush condition against said plate;

clamping means having an open condition to receive the loose stack of pages and a closed condition to clamp the stack of pages, said clamping means being mounted on a slide guide means which is movable parallel and normal to the plane of said form bottom, said parallel movement of said clamping means extending from the location of said abutment plate to a location above said trough arrangement and said normal movement of the back of the stack of pages clamped in said clamping means extends from said higher level of said abutment plate to said form bottom; and means for retaining a portion of adhesive strip in a position covering said trough arrangement.

2. Apparatus according to claim 1, wherein the tops of the form walls, which are remote from the form bottom, are covered over by guide bars which accommodate the respective portion of adhesive strip between them.

3. Apparatus according to claim 2, wherein at their sides which are towards the tops of the form walls the guide bars are each provided with a respective recess for suitably accommodating the adhesive strip portion.

4. Apparatus according to claim 3, wherein the recess is formed as a groove.

5. Apparatus according to claim 4, wherein at their ends at which the adhesive strip portion is inserted, the guide bars are provided with an upwardly bent portion which enlarges the recess in a funnel-like configuration.

6. Apparatus according to claim 1, wherein the form walls are provided with bevels which enlarge the configuration of the trough arrangement in a funnel-like shape.

7. Apparatus according to claim 6, wherein the bevels taper down in the same direction, in the longitudinal direction of the form walls.

8. Apparatus according to claim 6, wherein the tops of the form walls extend at a slightly inclined angle relative to the form bottom, along the longitudinal direction thereof, and in the same direction, in the case of both form walls.

9. Apparatus according to claim 8, wherein at least one form wall is mounted to be laterally displaceable and said form wall is connected to a displacement mechanism for pulling the form wall away from the stack of pages before the stack of pages is inserted and before it is withdrawn, and for causing, between said phases in displacement, the form wall to be pressed against the stack of pages.

10. Apparatus according to claim 9, wherein, for the purposes of using adhesive strip portions which bear a fusion-type adhesive, the form bottom is provided with a heating means.

11. Apparatus according to claim 10, wherein for the purposes of restricted heat transfer, the form walls bear against the form bottom by way of projections which are distributed along the form walls.

12. Apparatus according to claim 5, wherein the guide bars are held at a spacing from the tops of the form walls.

* * * * *